United States Patent [19]

Beck et al.

[11] Patent Number: 5,056,771

[45] Date of Patent: Oct. 15, 1991

[54] APPARATUS FOR CONTROLLING INTERPAGE GAPS IN PRINTERS AND METHOD OF INTERPAGE GAP CONTROL

[75] Inventors: James L. Beck, Versailles; Stanley Dyer, Lexington, both of Ky.

[73] Assignee: Lexmark International, Inc., Greenwich, Conn.

[21] Appl. No.: 399,633

[22] Filed: Aug. 25, 1989

[51] Int. Cl.[5] ..... B65H 3/06

[52] U.S. Cl. ..... 271/114; 271/10; 271/265

[58] Field of Search ..... 271/10, 114, 119, 199, 271/202, 258, 265, 270, 110, 111

[56] References Cited

U.S. PATENT DOCUMENTS

| | | | |
|---|---|---|---|
| 3,936,041 | 2/1976 | Shiina et al. | 271/265 X |
| 3,981,497 | 9/1976 | Feinstein, Jr. et al. | 271/114 X |
| 4,015,523 | 4/1977 | Evans et al. | 271/114 X |
| 4,289,052 | 9/1981 | Woolston et al. | 271/199 X |
| 4,318,540 | 3/1982 | Pannanen et al. | 271/265 X |
| 4,451,027 | 5/1984 | Alper | 271/270 X |
| 4,565,361 | 1/1986 | Tanaka et al. | 271/258 X |
| 4,691,912 | 9/1987 | Gillman | 271/265 X |
| 4,787,620 | 11/1988 | Goldkuhle | 271/10 |
| 4,809,969 | 3/1989 | Bastow et al. | 271/258 |

FOREIGN PATENT DOCUMENTS

| | | | |
|---|---|---|---|
| 104856 | 6/1983 | Japan | 271/110 |
| 51428 | 3/1986 | Japan | 271/270 |
| 197332 | 9/1986 | Japan | 271/110 |
| 41134 | 2/1987 | Japan | 271/265 |
| 267633 | 11/1988 | Japan | 271/270 |

*Primary Examiner*—Robert P. Olszewski
*Assistant Examiner*—Boris Milef
*Attorney, Agent, or Firm*—Laurence R. Letson

[57] ABSTRACT

An interpage gap control, which acts to optimize the throughput of a printer or other device, which utilizes fed pages, monitors the time for a page to be picked and fed to a sensor and the time for the page to pass the sensor. By using these time periods and other constants, the control calculates a delay time from the detection of the leading edge of the page at the sensor. This delay time must expire before the next page may be picked and fed. The control adjusts the delay period by comparing the time periods measured to reference values for the respective periods and if the measured values vary therefrom, adjusts the reference values. The adjustment of the values is made in small increments when the adjustment will tend to narrow the gap width and will replace the reference values with the measured value when the gap must be widened. This insures that the optimum width is approached cautiously, while expanding the gap quickly to avoid a jam condition when the measured time values indicate that the gap has unduly narrowed.

4 Claims, 4 Drawing Sheets

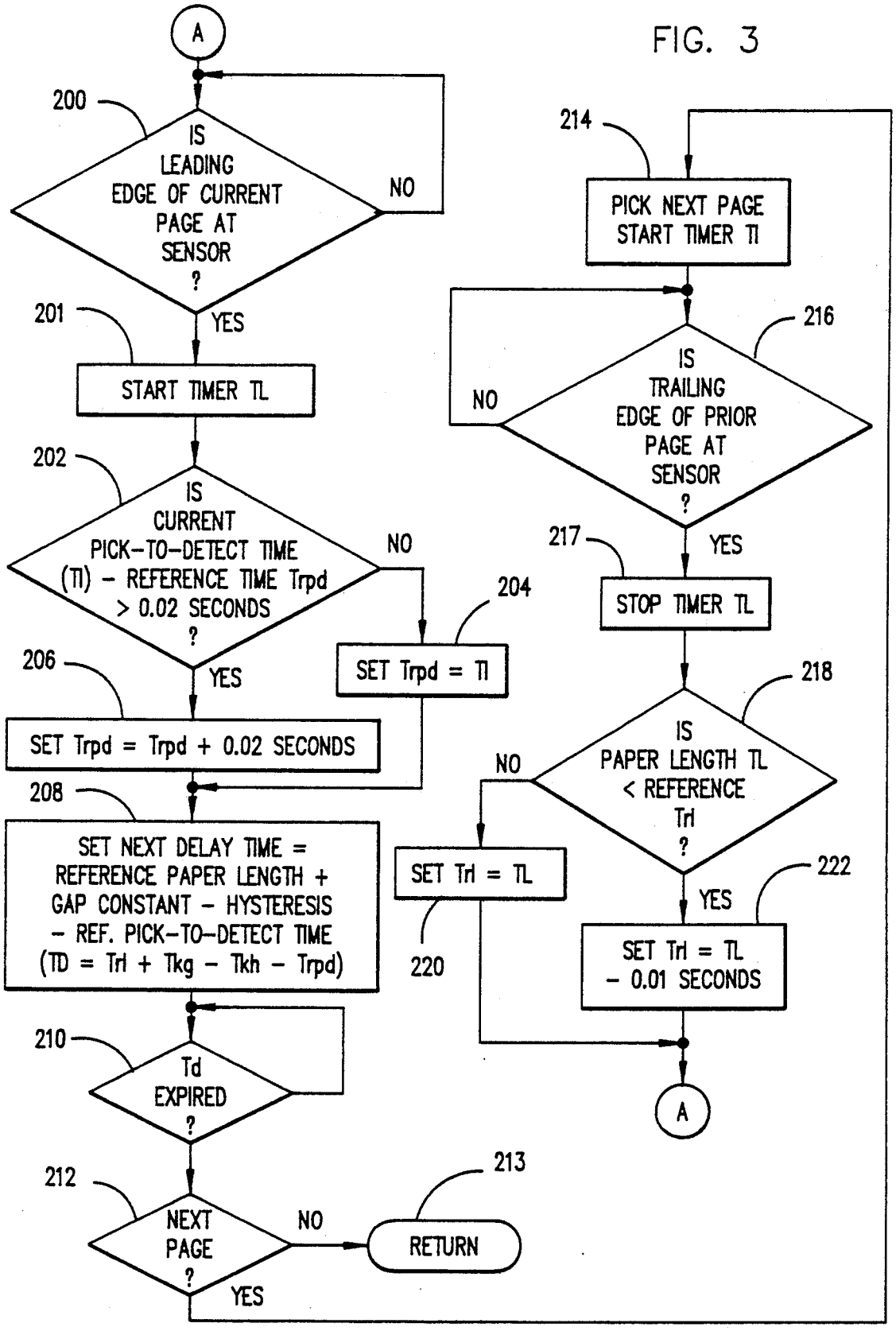
FIG. 3
A
200
IS LEADING EDGE OF CURRENT PAGE AT SENSOR ?
NO
YES
201
START TIMER TL
202
IS CURRENT PICK-TO-DETECT TIME (Tl) - REFERENCE TIME Trpd > 0.02 SECONDS ?
NO
YES
204
SET Trpd = Tl
206
SET Trpd = Trpd + 0.02 SECONDS
208
SET NEXT DELAY TIME = REFERENCE PAPER LENGTH + GAP CONSTANT - HYSTERESIS - REF. PICK-TO-DETECT TIME (TD = Trl + Tkg - Tkh - Trpd)
210
Td EXPIRED ?
212
NEXT PAGE ?
NO
YES
213
RETURN
214
PICK NEXT PAGE START TIMER Tl
216
IS TRAILING EDGE OF PRIOR PAGE AT SENSOR ?
NO
YES
217
STOP TIMER TL
218
IS PAPER LENGTH TL < REFERENCE Trl ?
NO
YES
220
SET Trl = TL
222
SET Trl = TL - 0.01 SECONDS
A

APPARATUS FOR CONTROLLING INTERPAGE GAPS IN PRINTERS AND METHOD OF INTERPAGE GAP CONTROL

FIELD OF THE INVENTION

The invention relates to printers and more particularly, to the control of the interpage gap during continuous printing to reduce the gap to a minimum for maximizing throughput while at the same time minimizing the chances of reducing the gap to the point that the printer fails due to a paper jam condition.

BACKGROUND OF THE INVENTION

In printers, where there is a capability of feeding multiple sheets, the sheets must be fed to the printer in such a manner as to not overlap the pages. This gap control may be handled in one of several different ways. One technique is to stage the paper or feed the sheet to a known reference point near the printing mechanism and abut the paper against a stop. When the appropriate moment occurs, to feed the sheet to the printing mechanism, the gate or stop is withdrawn and the sheet fed. This staging inherently extends the interpage gap and reduces the throughput of the printer.

An alternate approach to the staging of the paper is to continuously feed the sheets but at a speed and spacing that even with page to page length variations and variations in the feed speed of different sheets, the gap is sufficiently large as to prevent the overlapping of the adjacent sheets or the reduction of the gap to a point that the machine detects a condition that it cannot distinguish from a paper jam, requiring that the printer be shut down. When the gap is enlarged to accommodate the worst case condition, the effective throughput of the printer is severely degraded since the print mechanism is idle for periods significantly in excess of that necessary for reliable operation.

It is desirable to minimize the gap spacing, consistent with the printer design to eliminate undesired idle time.

At the same time, it is important that the gap between sheets not be narrowed too severely and the controls of the paper feed system be misled into recognizing conditions that would otherwise indicate a paper jam, thereby requiring the printer to be shut down and the operator to clear the condition and restart the machine.

SUMMARY OF THE INVENTION

The parameters affecting the gap between adjacent sheets in the stream of sheets fed to the print mechanism of a printer, where the sheets are not staged, are detected and if such as to produce a gap that is too narrow, the next gap is widened by delaying the pick times of the succeeding sheet to provide the necessary safety margin, while if the detected parameters are such as to widen the gap, the control for the paper feed and the printer will pick the following sheet at a time that will narrow the gap slightly and if the next gap is still excessively wide, the gap is narrowed slightly again, through the pick time being adjusted.

The time required to feed the first sheet of paper from the paper tray to the sensing station is determined and stored as a time standard for the pick-to-detect time. At the time that the sheet is detected at the sensor, a timer is started and runs until it equals a value which is a default delay time. The delay time is the interval from the detection of a sheet to the picking of the following sheet.

As the first sheet moves through the sensor station, a timer runs to determine the paper length. This time includes a factor that reflects the hysteresis of the sensor. This time value is compared against an initial default paper length time value stored in the control memory. If the paper length time is greater than the stored default paper length time, the new paper length time is used to replace the stored paper length time. Similarly, if the paper length time is less than the stored paper length time, the stored paper length time is replaced by a time value which is slightly smaller than the stored paper length time.

The delay time from the detect time of the current sheet is calculated from the stored paper length, the current pick to detect time, the desired gap length time and the hysteresis time constant, and the resulting delay time value used to control the pick operation of the paper picker.

A more detailed understanding of the control of the interpage gap can be had from the drawings and the following Detailed Description of the Invention.

DRAWINGS

FIGS. 2 and 3 are flow diagrams of the operation of the controls for controlling and feeding of paper in a printer.

DETAILED DESCRIPTION OF THE INVENTION

Figure 1:
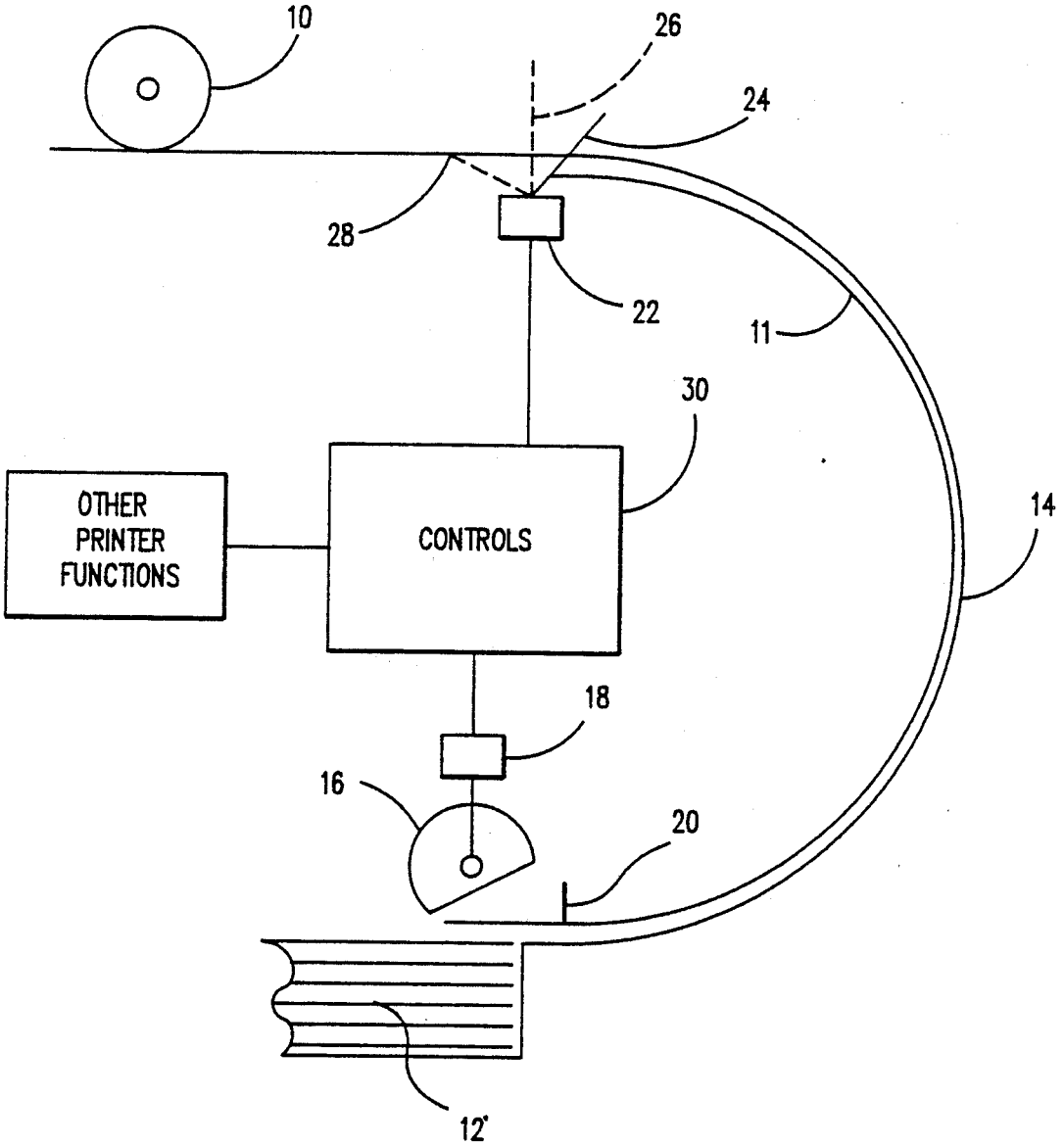
FIG. 1 is a schematic diagram of a typical printer paper feed path with associated feed, detection and utilization devices, as well as reference points.

In order to control the interpage gap in feeding paper to a printer, reference is made to the diagram of the paper feed path of a printer, illustrated in FIG. 1. FIG. 1 is a paper path which is exemplary of a printer where the image printed is placed on a drum 10 which has photoconductive properties and the image is developed and transferred to the sheet using known and conventional electrophotographic techniques. The placement of the image on the drum 10 is by an exposure means not shown and not a part of this invention. The placement of the image on the drum 10 may be controlled to position it such that the image will be placed in the proper relative position on the sheet of paper 11. It is, accordingly, necessary to know the position of the paper leading edge with a high degree of precision. This is accomplished with the sensor 22 which uses a finger or member 24 to engage the paper sheet 11 as the sheet is fed toward the drum 10.

Paper is stored in bulk quantities in stack 12 as is conventional. The sheets of paper 11 are picked by the D roll 16 and started along paper feed path 14 as illustrated. D roll 16 is activated by solenoid 18 and the time at which the solenoid 18 is activated to pick the paper sheet 11 is referred to as the pick time. Pick time is a point along a time sequence and is displaced by a delay time from the previous sheet detect time. The paper path is defined by conventional paper feed apparatus 15, driven by drive motor 17 which also drives the D roll 16, under the control of the solenoid 18.

Upon picking, the paper sheet 11 passes pick point 20 and progresses along the paper path 14 until the leading edge engages finger 24. At that point, the paper sheet 11 will displace the finger 24 until it occupies the position indicated by reference numeral 26. At position 26, the sensor 22 detects the arm position and hence the presence of paper sheet 11 at the detect position 26, with its leading edge at position 26. The sensor 22 then transmits the detect signal to controls 30.

Controls 30 is comprised of a microprocessor 40 running under program control. The preferred embodiment of the controls 30 comprises a Motorola 68000 microprocessor but it should be understood that other microprocessors of other manufacturers may be used with equal results. The microprocessor 40 is provided with sufficient memory 42, FIG. 4, or registers to store the times necessary to control the interpage gap, as will be described in more detail below.

The general operation of the paper feed portion of the printer of FIG. 1 starts with the operation of the solenoid 18 by the controls 30, to rotate the D roll 16. The rotation of D roll 16 causes the top sheet 11 on the paper stack 12 to be picked and fed to the paper path 14. As the sheet 11 is fed along the paper path 14 by continuously rotating feed rolls 15 and engages the sensor arm 24 and then displaces the arm 24 to the detect position 26, the microprocessor times the pick to detect time (TI) for the current sheet. As the paper progresses past the sensor 22, the arm 24 will be displaced to position 28 and remain there until the paper sheet 11 passes and the trailing edge releases arm 24.

Since the paper sheet 11 must actually travel a distance greater than its length from the detect position to the point at which the trailing edge disengages the arm 24 in position 28 and the arm 24 will require some time to return to the detect position 26, the sensor has some mechanical hysteresis which is determinable by the distance from the detect position 26 to the disengagement of the arm from the paper sheet 11 at position 28 (hysteresis distance), the velocity of the paper sheet 11 and the time for the flyback of the arm to the detect position 26. For example, with a 120 inch per minute paper feed velocity, and a 0.4 inch hysteresis distance, the travel time equals 0.2 seconds and with a measured 0.06 seconds arm flyback time, the hysteresis time may be determined as a constant of 0.26 seconds.

It should be noted at this point that the arm 24 of sensor 22 must return to at least detect position 26 to indicate the passage of the trailing edge of sheet 11. If the following sheet is too close to allow the arm 24 to pass back through position 26, and then be pushed forward through position 26 by the following sheet, the sensor will not output any signal that would be interpreted as an indication of the end of one sheet and the leading edge of the next. This will indicate to printer controls 30 that a sheet 11 of paper is jammed in the machine and is not moving. The machine will be shut down and no image will be placed on the second sheet, since the microprocessor does not know where the second sheet begins and therefore is unable to place the image relative to the leading edge thereof.

The paper sheet 11 length is measured in time units by the timing of the period between the detect time (time at which the sensor 22 detects the arm in position 26) and the detection of the arm again being in position 26 during flyback, including the hysteresis time constant. The result is length of the paper sheet 11 expressed in time units or the time length of the sheet (TL).

Figure 2:
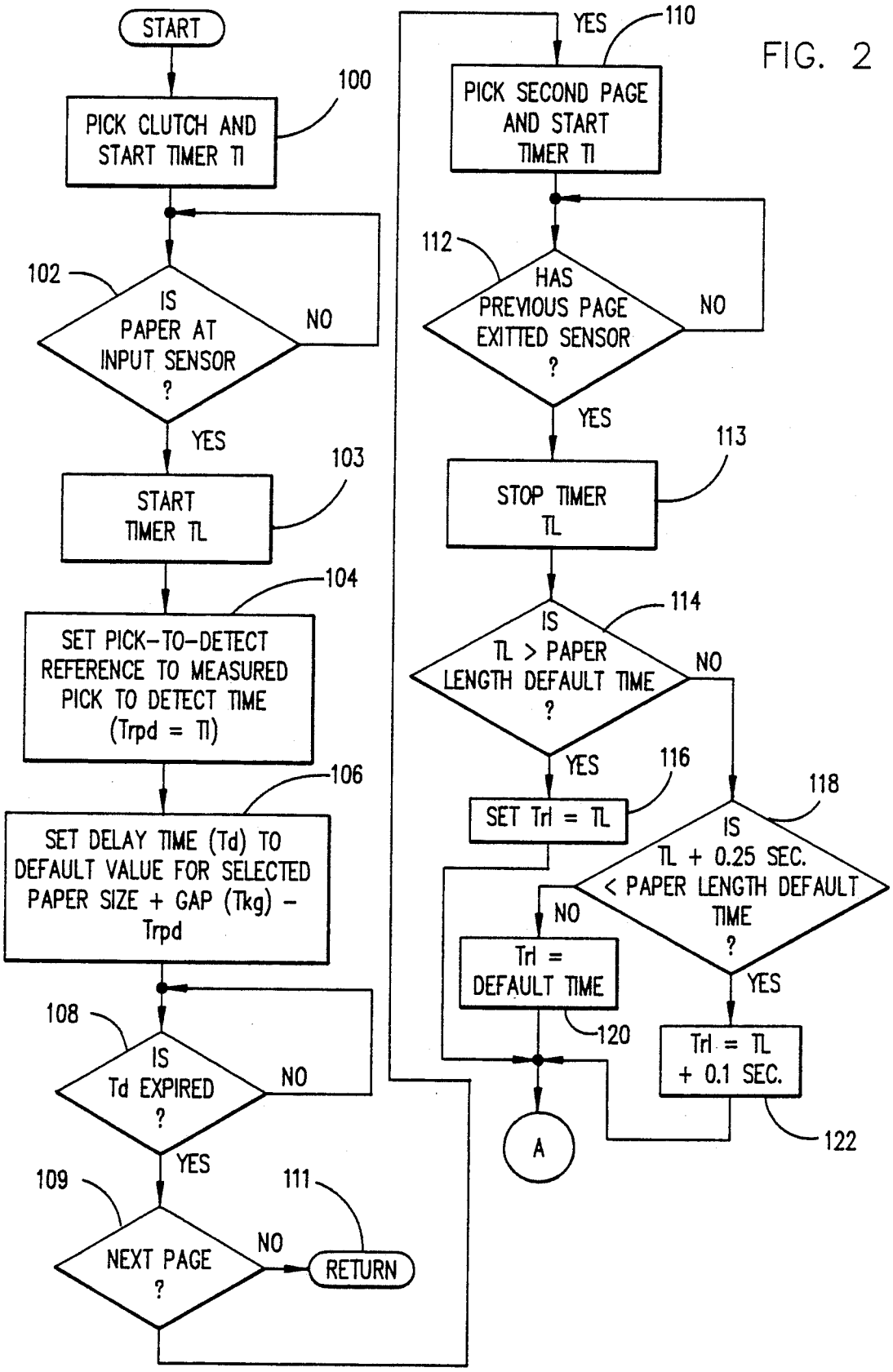

Referring to FIG. 2, the flow diagram shows the control flow of the microprocessor 40 for the first sheet fed. Clearly, the microprocessor 40 controls many other aspects of the operation of the printer, but those other aspects do not directly affect the paper feed and gap control operation.

The solenoid 18 is picked by a signal from the control 30 and the microprocessor 40 starts timing the pick-to-detect time interval at that point, in operation 100.

The microprocessor 40 will continually sample sensor 22 to determine when the paper is at the detect position 26, in operation 102. If not, the sampling will repeat until the sensor 22 indicates that the paper leading edge has moved arm 24 to the detect position 26, with the control then flowing to operation 103.

In operation 103, the microprocessor starts the paper length timer, to determine in terms of time units, the length of the page being fed passed the sensor 22. The value of the time representing the paper length, as determined by the sensor outputs, will be designated TL.

Since the sheet 11 being fed is the first of an assumed sequence of sheets, the pick-to-detect reference (Trpd), is stored in a memory location in the memory 42 associated with the microprocessor 40. This value, Trpd, then becomes a reference against which the next sheet pick-to-detect time is compared to insure that the sheet is being fed at the same rate as the preceding sheet. Since there is no previous sheet and no previous pick-to-detect time, the Trpd is assumed to be the currently measured value.

The second sheet must be fed at a time which will produce a desired gap between the first and second sheets. Since the delay time will be calculated based on the operator input of sheet size and the desired gap dimension, the delay from the first sheet detect time will equal the paper length divided by the feed velocity plus a similarly calculated constant for the gap length minus the pick-to-detect time reference value. This delay time (Td) is a computed delay time dependent upon the proper entry of the paper length by the operator. The operator may select the paper size being used by activating a switch 21 on the machine to correspond to the paper size being used. This switch 21 signals the microprocessor what value to select from the memory that represents the length of the sheet, in terms of time units. The delay time, Td, is the time necessary to feed the remainder of the preceding sheet past the pick point 20 and an additional distance equal to the gap desired, for example 1 inch (2.54 cm). Using this equation described above and the resulting value, the microprocessor 40 sets the delay time, Td, in one of the memory 42 locations in operation 106.

In operation 108, the just stored Td is compared with the time elapsed from the detect time. If the Td is larger than the time elapsed since detect time, the flow will loop back and the sampling of the elapsed time will continue until the delay time, Td, has expired. It should be noted that a short page length may result in the delay time expiring before the first page is detected, and the second page pick time will be immediately after the setting of the delay time, Td.

The printer controls checks the number of pages of data that has been sent to it by its source against the number of pages it has fed and if these two quantities are not equal, there is a next page, and that condition is determined in operation 109. Should there be no next page, the flow will return to the control of the printer other than the paper feed, in operation 111.

As soon as the delay time, Td, is found to have expired and the need for a next page determined in operation 109, the clutch 18 is activated to pick the succeeding sheet in operation 110. The timer is again started to time the pick-to-detect time for the current sheet (TI).

The microprocessor 40, in operation 112, will then sample the sensor 22 to determine if the paper 11 has cleared the sensor arm 24 and it has returned to detect position 26, and if not, will continue sampling. If the sensor indicates that the paper has exited, the timer is stopped in operation 113 and the time value between the detect time and the sensor exit time is stored as the current page length time (TL). For the first page, the current page length time, TL, is compared in operation 114 to the paper length default time stored in memory 42. If TL value is greater than or equal to the stored default time, then Tr1 is set equal to TL in operation 116. If the operation 114 comparison is negative, then 0.25 seconds is added to TL and the sum compared to the paper length default time in operation 118. Should the above sum be less than the paper length default time, then Tr1 is set equal to TL+0.1 second, to partially correct for the extremely short measured paper length time, TL, in operation 122.

Figure 4:
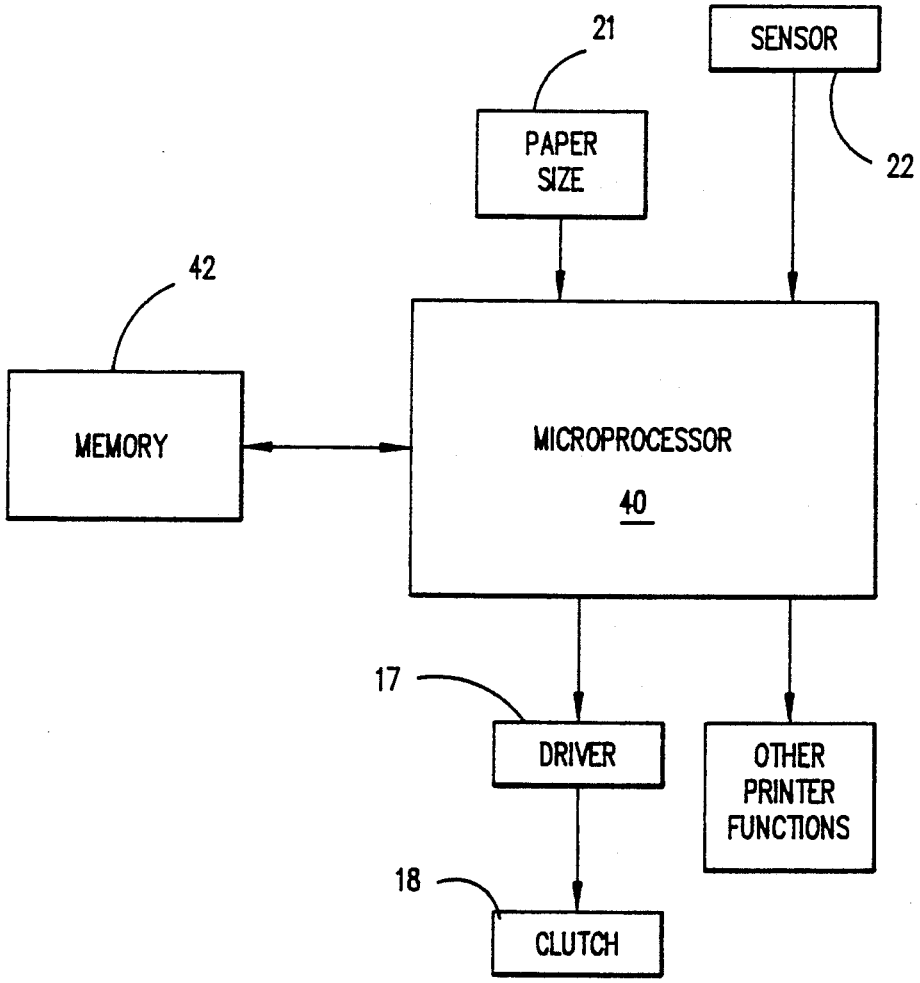
FIG. 4 is a block diagram of a printer control.

When the operation 118 test results are negative, the Tr1 value is set equal to the default time, based on the operator paper size input through selector 21 in FIG. 4. It should be noted that the time Tr1 is not a true representation of the length of the page since it contains the hysteresis time value but still serves as a reliable indication of relative sheet length.

Now referring to FIG. 3, in operation 200 the control flow continues from FIG. 2. The sensor 22 is queried to determine if the leading edge of the next page 11 is at the detect position 26. If the sensor 22 does not indicate the presence of the next sheet 11, the microprocessor 40 continues to query the sensor 22 until the next sheet 11 is detected at the sensor 22 by moving the arm 24 to the detect position 26. Thereupon, the microprocessor 40 will start the timer TL in operation 201 and terminate the timing of the pick-to-detect interval, TI, for the second page and compare it, in operation 202, to the reference pick-to-detect time Trpd. If the current TI does not exceed the reference value, Trpd, by more than 0.02 seconds, the new Trpd is set equal to the current pick-to-detect time, TI, in operation 204.

This condition, of a fast pick-to-detect time, relative to Trpd, may be due to a return to normal from a slow pick to detect time or a partially fed sheet which was shingled on the previous feed operation. In any event, the gap was detected, since a detect time was sensed, and the current sheet is feeding properly to this point. However, there is concern that the next sheet may also have a fast Trpd and the delay time must be adjusted in a more aggressive manner. Hence, the setting of Trpd to equal the pick-to-detect time, TI, in operation 204.

Should, however, the current TI exceed the reference value, Trpd, by more than 0.02 seconds, the reference pick-to-detect time is updated by adding 0.02 seconds to existing reference time, in operation 206.

The flow from operation 204 or 206, will provide the updated Trpd which then may be used in operation 208 to calculate the delay time for the third sheet of the sequence. The determination of the delay time, Td, is determined from the reference paper length, Tr1, by subtracting the hysteresis constant, Tkh, adding the gap constant, Tkg, and subtracting the newly determined pick-to-detect time reference, Trpd.

Upon the determination of the delay time for the third or next sheet pick operation, a determination is made as to whether the delay time has already expired, in operation 210. If some increment of delay time remains, the flow branches back to operation 210 for another test of the delay time expiration. Upon the expiration of Td, the flow is to decision operation 212 where a determination is made as to whether there is a page to follow as discussed with reference to operation 109 above. If the current page which has been sensed by the sensor 22 is the last page in the print sequence, the control will branch at operation 212, to operation 213, to return to the main control program which controls the other operations of the printer, including the completion of the printing operation and the shutting off of the printer after the last sheet 11 is printed.

If there is a next page to be printed in this sequence, the flow is then to operation 214 where the clutch is picked to feed the third or subsequent sheet in the sequence. Concurrently with the picking of the next sheet, the timing of the pick-to-detect time interval is initiated to determine the current TI for the third or subsequent sheet in the sequence.

Thereafter, the sensor 22 is poled to determine if the trailing edge of the current sheet 11 has released the arm 24 of the sensor 22 indicating the passage of the trailing edge of the sheet 11 in operation 216. If not, the poling continues until the trailing edge of the sheet 11 releases the sensor arm 24. When the current sheet releases the sensor, the sensor will signal the microprocessor 40 to terminate timing of the paper length, TL, in operation 217 and in operation 218 the current paper length time TL is compared with the paper length reference time, Tr1. If the current paper length time, TL, is equal to or greater than the reference time Tr1, the reference value Tr1 is set equal to the current paper length time, TL, in operation 220.

Where the current paper length time, TL, varies from the reference paper length time, Tr1, such that it is greater than the reference time, the gap can be greatly effected with the feeding of the next sheet. It is imperative to delay the picking of the next sheet to a time that will insure that the gap is not closed sufficiently to cause the sensor to fail to sense the interpage gap and indicate to the microprocessor that there is a paper jam, with the shutting off of the machine.

While not a part of this invention, paper jams are detected and the printer shut down if the TL timer reaches a value exceeding the value associated with the selected page size, by an amount representing, typically, 0.75 inches (1.90 cm).

In the case where the current paper length time, TL, is less than the reference value for paper length, the reference value is decreased by 0.01 seconds, in operation 222.

Following the adjustment of the paper length reference time, Tr1, the flow loops back from operation 220 or operation 222 to operation 200 where the logic continues to cycle for each succeeding sheet. Accordingly, the gap is narrowed or widened as needed to improve throughput, with due consideration for the need to maintain a detectable gap between adjacent sheets.

Decreasing the reference value representing the paper length has the effect of reducing the delay time and accelerating the pick time for the next sheet. When the delay time is accelerated, the gap between the current sheet and the subsequent sheet is shortened or closed to reduce the non-productive time of the printer as the gap between sheets in the sequence pass by the printer mechanism.

Thus, it can be seen that when either the pick to detect time is not more than 0.02 seconds more than the reference pick-to-detect time or where the paper length time, TL, exceeds its respective reference, the gap between adjacent sheets is narrowing and in order to prevent machine shut down, it is necessary to widen the gap rapidly to prevent the possibility of shutdown. When the opposite conditions exist, the gap is overly wide and it may be closed to improve throughput. In order to not overly react to a variation of the times that would indicate a widening of the gap and then find with a subsequent sheet that, for example, a short sheet of paper was in the hopper and formed an anomalous condition, which if immediately corrected for, would potentially cause a jam indication.

A slow or large pick-to-detect time may be an indication of a poor picking of the sheet where the picking mechanism slipped relative to the paper and thus did not start the paper sheet through the feed mechanism properly, and on time. Similarly, a fast or smaller pick-to-detect time may be caused by a sheet that was shingled out into the feed path when the previous sheet was picked. This shingling will reduce the distance to be traversed by the sheet and accordingly, the time of traversal.

A slow pick-to-detect time has the effect of reducing the delay time, Td, to speed up the throughput. If the previous sheet had a slow pick-to-detect time that was an anomaly, and an abrupt change of Td was made on that basis, a failure could be precipitated on the following sheet feed.

The use of loops for repetitive sampling at operations 102, 108, 112, 200, 210 and 216 represent one approach of detecting the condition being tested for. A more efficient approach, allowing the microprocessor to handle other non-related operations during the time represented by the loops would be to operate the microprocessor on an interrupt basis, where an interrupt signal is sent to the microprocessor when a condition changes, such as when the delay time has expired or when the arm 24 returns to the detect position 26 after being released by the trailing edge of sheet 11. The result of the two different approaches is the same with the interrupt approach being more efficient with the capabilities of the microprocessor 40.

The microprocessor 40 is shown in FIG. 4. The microprocessor receives signals from the sensor 22 which indicate the passage of the sheet 11 and utilizes those signals in starting and stopping timers for the paper length and pick-to-detect time. Those times are stored in memory locations in memory 42 and then updated to form the reference times. Also there is stored in memory 42 the other information needed to control the printer paper feed such as the delay time, the default paper length, hysteresis constant, gap constant and many other parameters associated with the printing operation. The storage of these times and other operating parameters may be stored and retrieved from the memory as needed, and will not necessarily occupy dedicated positions in the memory. The microprocessor 40, based on the operations represented by the flow diagram in FIGS. 2 and 3, will send signals to the driver 44 which controls the clutch 18, which in turn controls the drive of the D roll 16.

The gap control operations and the compensations are limited to a single print run. When a new print run starts, the entire sequence of FIGS. 2 and 3 restarts. The best mode for the implementation of this invention is to program the microprocessor to perform the operations represented by the flow diagram of FIGS. 2 and 3. While detailed instruction listings are not included herein, a programmer of ordinary skill in the art can, using the flow diagram in FIGS. 2 and 3, write instructions to carry out the invention. It should be noted that the description herein is generalized to the point that it is applicable to any general purpose microprocessor, and the detailed program instruction listing would vary, depending upon the programmer and the selection of the microprocessor.

The invention described herein is not strictly applicable to electrophotographic printers but may used in any printing technology that uses paper sheet feed where the feeding is not a staged feeding, and where the width of the interpage gap is controlled to optimize printer throughput.

While the sequence of operations is illustrations without the other operations necessary to operate the printer, it should be understood that microprocessor 40 will be performing many other non gap control operations during the feeding of the sheets and the programmer may accommodate this in the writing of any control program for the printer.

We claim:

1. An interpage gap width control for a utilization device having a page feeding apparatus comprising a page feed path for feeding pages to said utilization device, in a non-staged manner, and means for picking said pages, said control comprising:

means for monitoring passage of said pages along said feed path, including a sensor means, positioned at least partially in said feed path, for detecting the passage of a leading edge and a trailing edge of one of said pages, relative to said sensor means;

means responsive to said means for monitoring passage for controlling said means for picking for further controlling the width of said gap between said pages, including timing means for timing at least a first period of time from picking of said page until said page actuates said sensor means and a second time period from said actuation until said page deactivates said sensor means.

2. An interpage gap width control for a utilization device having a page feeding apparatus comprising a page feed path for feeding pages to said utilization device, in a non-staged manner, and means for picking said pages, said control comprising:

means for monitoring passage of said pages along said feed path, including a sensor means, positioned at least partially in said feed path, for detecting the passage of a leading edge and a trailing edge of said page, relative to said sensor means;

means responsive to said means for monitoring passage for controlling said means for picking for further controlling the width of said gap between said pages, including timing means for timing at least a first period of time from picking of said page until said page actuates said sensor means and a second time period from said actuation until said page deactivates said sensor means; and further comprising determining means for determining, in response to said first and second time periods, a delay time measured from said page actuating said sensor means, said delay time defining the earliest possible time for picking a succeeding page.

3. An interpage gap width control for a utilization device having a page feeding apparatus comprising a page feed path for feeding pages to said utilization device, in a non-staged manner, and means for picking said pages, said control comprising:

means for monitoring passage of said pages along said feed path, including a sensor means, positioned at least partially in said feed path, for detecting the passage of a leading edge and a trailing edge of said page, relative to said sensor means;

means responsive to said means for monitoring passage for controlling said means for picking for further controlling the width of said gap between said pages, including timing means for timing at least a first period of time from picking of said page until said page actuates said sensor means and a second time period from said actuation until said page deactivates said sensor means, and;

further comprising determining means for determining, in response to said first and second time periods, a delay time measured from said page actuating said sensor means, said delay time defining the earliest possible time for picking a succeeding page;

said means for monitoring passage further comprises means for determining a reference time value for each of said first and second time periods, means for comparing said first and second time periods with said respective reference time values and means for modifying said reference time values as pages are fed, in response to deviation of said time periods from said reference time values, said means for modifying further operative to modify said reference time values incrementally with a fixed, predetermined increment when said modification will tend to narrow said gap width preceding the next page fed.

4. The interpage gap control of claim 3 wherein said means for modifying is further operative to modify said reference time values to newly timed values where the modification will result in an expansion of the gap width, preceding the next page fed.

* * * * *